US005735601A

United States Patent [19]

De Bona et al.

[11] Patent Number: 5,735,601

[45] Date of Patent: Apr. 7, 1998

[54] DEVICE FOR PREPARING MIXTURES FOR DISSOLVING DYES IN POWDER FORM IN TEXTILE PLANTS

[75] Inventors: Paolo De Bona, Soprana; Walter Lanaro, Trivero, both of Italy

[73] Assignee: Lawer S.r.l., Italy

[21] Appl. No.: 669,033

[22] Filed: Jun. 24, 1996

[30] Foreign Application Priority Data

Jun. 23, 1995 [IT] Italy ..... TO95A0527

[51] Int. Cl.[6] ..... B01F 15/02

[52] U.S. Cl. ..... 366/150.1

[58] Field of Search ..... 366/150.1, 241, 366/279, 27, 30, 32; 198/703, 706; 220/160, 164

[56] References Cited

U.S. PATENT DOCUMENTS

| | | | |
|---|---|---|---|
| 1,916,531 | 7/1933 | Robb | 366/30 |
| 3,727,889 | 4/1973 | Nagel . | |
| 4,268,175 | 5/1981 | Norlie et al. | 366/32 |
| 5,020,918 | 6/1991 | Faccia | 366/279 |
| 5,261,739 | 11/1993 | De Casta Goncalves et al. | 366/30 |
| 5,383,726 | 1/1995 | Lanaro | 366/168 |

FOREIGN PATENT DOCUMENTS

| | | |
|---|---|---|
| 0599146 | 6/1994 | European Pat. Off. . |
| 4335255 | 4/1995 | Germany . |

*Primary Examiner*—Tony G. Soohoo
*Attorney, Agent, or Firm*—Banner & Witcoff, Ltd.

[57] ABSTRACT

In a device particularly, but not exclusively, for preparing mixtures, for example, for dissolving dyes in powder form, and the like, in textile plants, the device comprises a tank which can receive buckets in which there is a product such as a pigment to be mixed with a vector, such as a liquid, which is supplied to the lower portion of the tank. At least one rotary turret associated with the tank has an arm on the free end of which there is a plate on which the buckets are deposited. As a result of a rotary movement about its axis followed by a lowering movement, the turret brings the bucket to a central position inside the tank which is closed at the top by a lid which can move vertically upwards and downwards. The rotation of the arm of the turret with consequent inversion of the bucket causes the pigment to fall into the tank in the bottom of which there is a mixer which brings about intimate and complete mixing of the product poured into the vector. The mixture thus obtained can be transferred automatically and selectively towards user stations by a pump acting in the bottom region of the tank. An assembly is provided for automatically washing the tank and the bucket upon completion of the mixing operations. The preferred application is in the dye-houses of textile plants.

29 Claims, 7 Drawing Sheets

W
VDS
Vn
V2
V1
VDUn
VDU2
VDU1
S
X104
104
100
101
102
103
X100
60
59
2
68
6
7
1
65
3
62
111
5
18
63
61
67
4
2a
17
115
66
113
64
114
15a
15b
14
13
FM51
11
12
16
16b
VR5
52
105
106
8
16a
8'
12'
H
C
S
L

DEVICE FOR PREPARING MIXTURES FOR DISSOLVING DYES IN POWDER FORM IN TEXTILE PLANTS

The present invention relates to devices for preparing mixtures, this term meaning, in general, products resulting from the association of several components by mixing, addition, dissolving, etc..

The invention has been developed with particular attention to its possible use for the dissolving of dying products in powder form, or the like, in textile plants, for example, for hydraulic transfer towards the points of use.

From this point of view, the present invention constitutes a a further development of the solutions described in the European patent application No. 93118274.5 and the Italian patent application No. TO94A000387 both in the name of the same Applicant.

In particular, the second application cited describes a device comprising a tank which can receive, from above, for example from a robot, buckets containing product to be dissolved. This product is usually a pigment to be mixed with a vector such as a liquid which is supplied to the lower portion of the tank. The buckets are held in an annular support which can be turned over so as to pour the product disposed in the buckets into the vector. Means are provided for washing the external and internal surfaces of the buckets. The mixture produced in the tank can be transferred automatically and selectively towards the user stations by means of pumping elements which act in the bottom region of the tank.

The object of the present invention is further to improve the solutions described in the cited prior applications both with regard to the carrying-out of the various stages of operation, particularly regarding the washing of the bucket, and with regard to the insertion of the buckets in the tank and their withdrawal therefrom, particularly with a view to the complete automation of these operations. This latter aspect is particularly important owing to the possibility of associating, for example, a pair of automatic units for loading and unloading the buckets, with each tank. As a result, a bucket containing new material to be dissolved can be placed in the tank immediately after the bucket used for the previous mixing operation has been removed from the tank.

According to the present invention, this object is achieved by means of a device having the specific characteristics claimed in the following claims.

Figure 1:
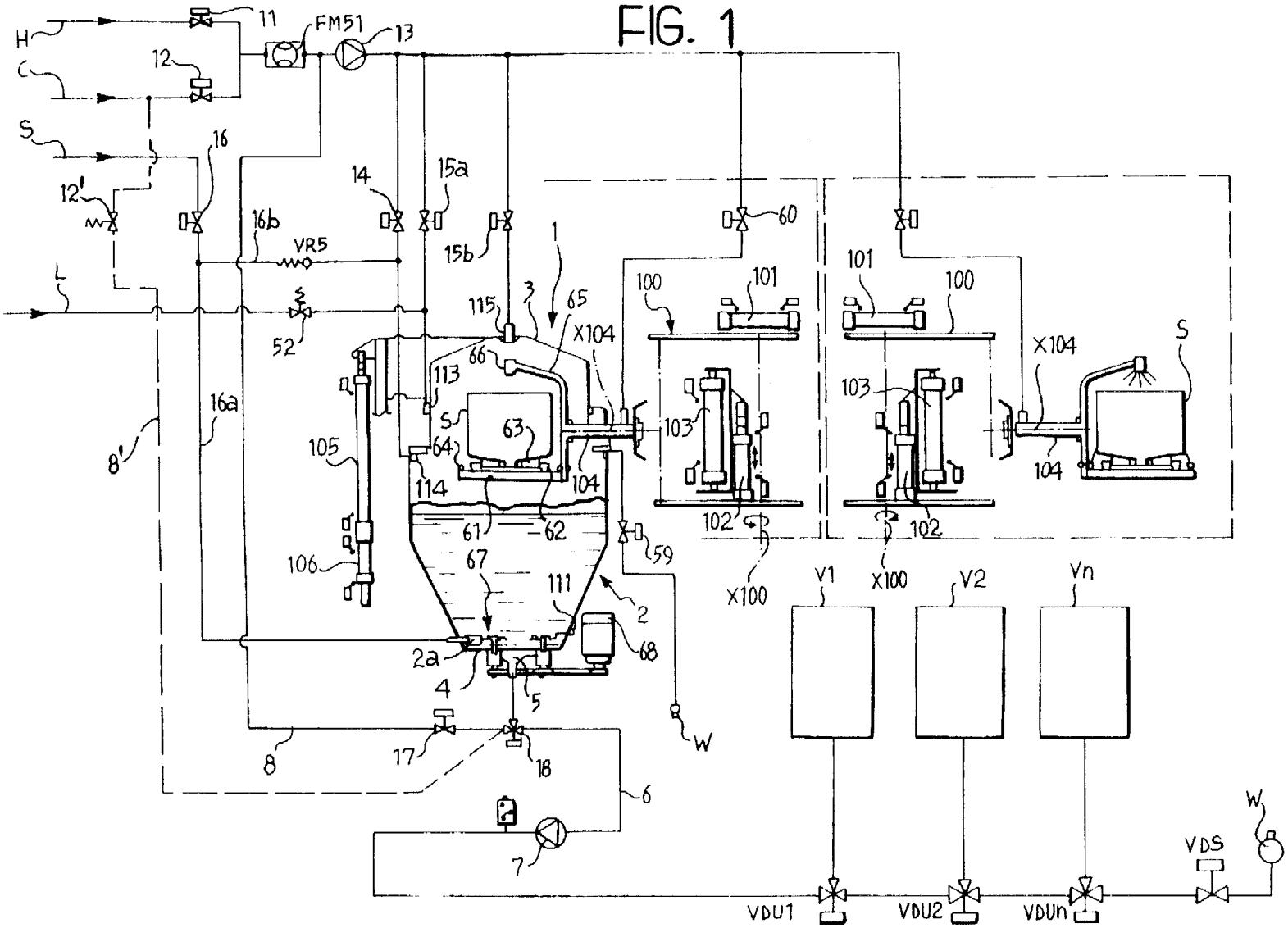

The invention will now be described, purely by way of non-limiting example, with reference to the appended drawings, in which:

FIG. 1 shows, in a generally central, vertical section, a device formed according to the invention with the respective associated fluid circuit, and FIGS. 2 to 13 show successive stages in the operation of a device according to the invention.

In particular, it will be assumed that the device according to the invention, generally indicated 1, is intended to receive containers in the form of buckets S loaded with a predetermined quantity of product P to be mixed, for example, a certain quantity (supplied in a metered manner—for example, by weighing—carried out in known manner) of dye to be dissolved (pre-dissolved) in a fluid vector.

By way of example, and according to a preferred embodiment, the device comprises at least one (and preferably two) units for supplying (loading and unloading) buckets S, each unit being configured as a turret 100 mounted on a respective base with the ability to rotate about a vertical axis X100 under the action of a drive device such as a fluid jack 101.

A further jack, indicated 102, brings about a vertical translational movement of the turret 100 (in the manner which will be described further below).

Finally, a further jack, indicated 103, has the function of causing a pivoting arm 104 which, as will be explained further below, is intended to support the buckets S, to rotate about a respective horizontal axis X104.

For clarity, it should be stressed that the selection of the use of fluid jacks, preferably hydraulic jacks, for the actuators 101 to 103 should be considered purely as an example. In fact, drive devices of other types could be used within the turret 100, possibly with the use of different solutions for the various drives.

With regard to the supply of operating fluid to the actuators, naturally, this is achieved by known means (pipes for the supply and discharge of pressurized fluid with associated travel detectors, the whole being subject to the control of a system for the general supervision of the operation of the device 1, piloted by a personal computer or PLC). All of this is achieved according to criteria well known to a person skilled in the art, rendering any specific description herein unnecessary.

As stated, in a preferred embodiment, the device 1 has two associated turrets 100, only one of which will be described in detail with reference to its structure and its method of operation. Naturally, it is intended that what is stated for one of the turrets also applies in almost identical manner to the other turret, bearing in mind that the two turrets in question are intended to cooperate in order automatically to load the buckets S into the tank 2 constituting the central element of the device 1 and to unload them therefrom.

According to the currently-preferred assembly arrangement, the tank 2 with two associated turrets 100 located in symmetrical positions relative to the tank 2 is situated at the downstream end of a conveyor line (not shown, but of known type) which:

takes the buckets S from the station in which the product to be dissolved is metered, and which is situated, for example, at the output of an automatic store (or, in general, also from a region for the storage of empty or full buckets) and transfers them to one of the turrets 100 for insertion in the tank 2 for a dissolving operation, and, in complementary manner, takes the buckets from one of the turrets 100 which has removed them from the tank 2 upon completion of an operation to invert and wash each bucket, in order to return the buckets towards a storage region.

As can be seen from the drawings, the tank 2 is constituted, essentially, by a cup-shaped body with an associated lid 3 which can move vertically under the action of a further actuator such as a fluid jack, indicated 105 and 106.

Both the tank 2 and the lid 3 are made of metal such as, for example, stainless steel or another material having the necessary strength, resistance to chemical attack, and ease of cleaning.

The body of the tank 2 is closed at the bottom by a funnel-shaped base 4. The latter has a central discharge opening 5 from which a pipe 6 extends, a pump 7, typically an electric pump, being interposed in the pipe 6.

The output of the electric pump 7 is connected, by means of a plurality of diverter valves VDU, VDU1, VDU2, VDU3, etc., connected in cascade with one another, to a plurality of respective user units V, V1, V2, V3 . . . , for example, dyeing vats. In cascade with the various valves VD1, VD2, VD3, etc. there is a discharge pipe in which a valve VDS is interposed, allowing the fluid (typically a washing fluid, as will be explained further below) present in the pipe 6 to be discharged to the exterior, represented in the form of a container W.

A three-way valve 18 is interposed between the discharge opening 5 and the pipe 6. As well as being connected to the pipe 6 (which, as has been seen, is intended to permit selective distribution of the solution prepared in the device 1 towards the user stations V1, V2, V3 . . .) the valve 18 is also connected to a further pipe 8. This pipe enables hot water coming from one or more sources (a boiler or the like) not specifically shown in the drawings, to be supplied to the pipe 6 and hence to the valve VDU and the relative users, or towards the discharge W with the purpose of washing the plant.

In the (non-limiting) embodiment described herein, the pipe 8, in which a control valve 17 is interposed, is connected by means of a liter-counter FM51 to two supply valves 11 and 12. These in turn are connected, according to widely known criteria, to two water supplies, that is, a line H for the supply of "hot" water (for example, at a temperature of the order of 80° C.) and to a line C for the supply of "cold" water (for example, at a temperature of the order of 50° C.).

The same supply line C is connected to an auxiliary hydraulic circuit 8' (shown by a broken line in the drawings) which has the function of preventing the solution prepared from accumulating in the spaces inside the valve 18 during the rotation of its obturator (usually a ball). A manual valve 12' is preferably interposed in the circuit 8' and serves for calibrating the flow-rate of the circuit.

To continue with the description of the hydraulic/fluid circuit associated with the device according to the invention, it can be noted that the output of the liter-counter FM51 is connected to the suction side of a further electric pump 13, the output of which is sent out through respective valves 14 and **15*a*, 15*b* towards three respective lines which enable water to be fed to the tank 2 (including the lid 3**) according to criteria which will be described further below.

A further line, indicated S, in which a valve 16 is interposed, is for supplying steam (coming from a corresponding steam source not shown specifically in the drawings). Downstream of the valve 16, the line V is divided into two branches **16*a* and 16*b***.

The first branch **16*a* extends towards a delivery (injection) outlet or set of outlets 2*a* situated in the lower portion of the tank 2 adjacent the base 4. The second branch 16*b* is divided, with the interposition of a non-return valve VR5, into two further branches, of which one is connected to the output of the solenoid valve 14 and the other is connected, according to criteria which will be described further below, to the rim of the tank 2 which is closed by the lid 3. The valve VR5 does not allow the steam to pass towards the tank 2** but permits the passage of water during one or more tank-washing cycles. The purpose is also to wash the inside of the pipe and the injection outlets associated with the tank, as will be described further.

Figure 2:
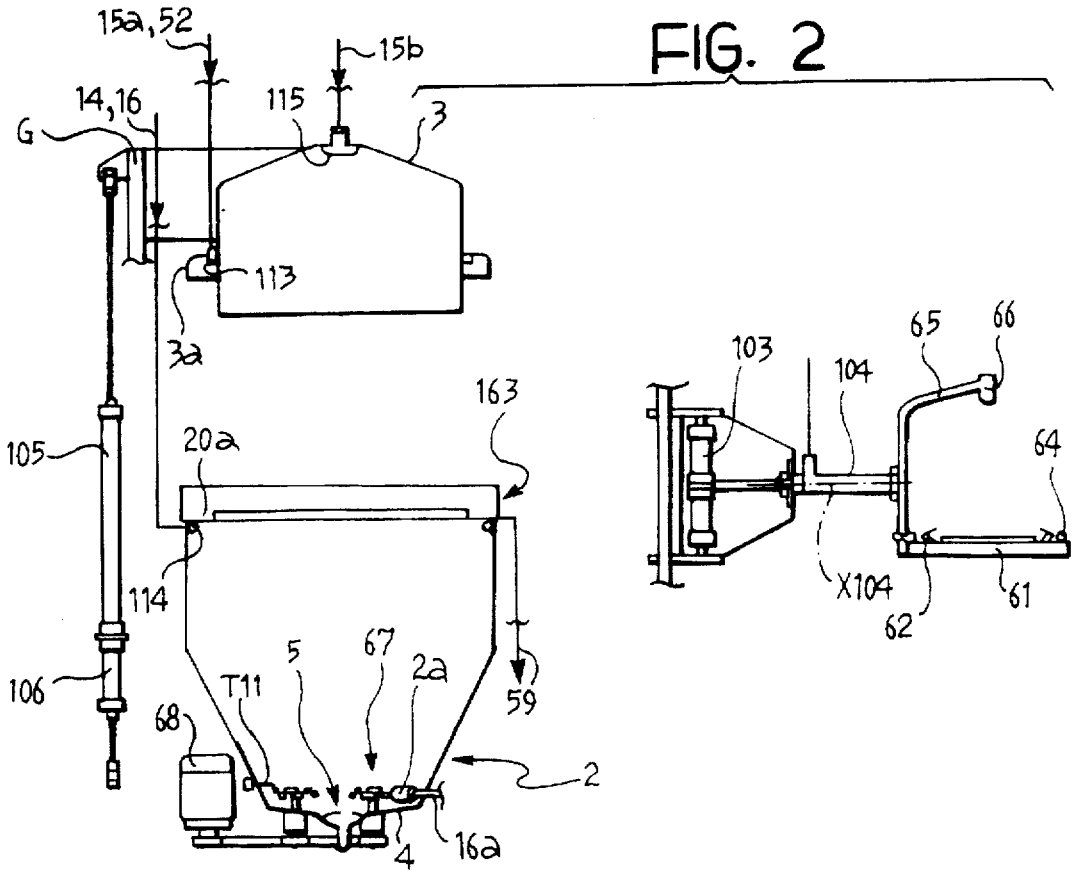
Figure 3:
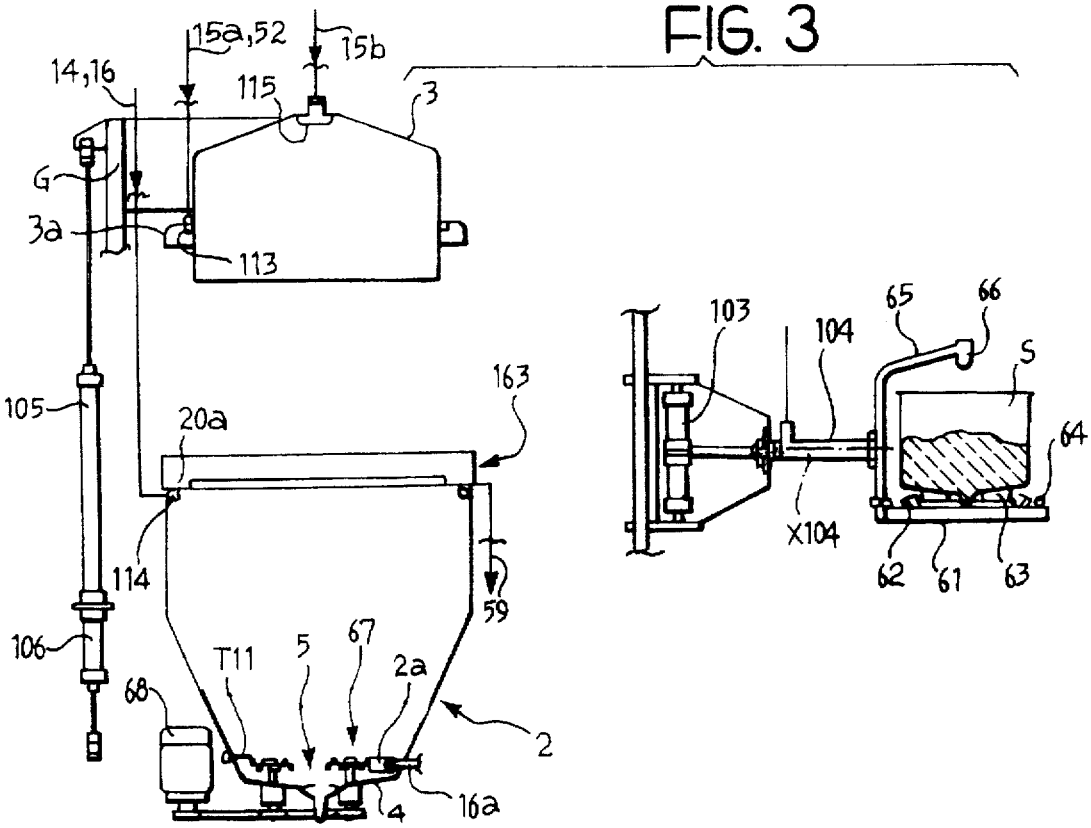
Figure 11:
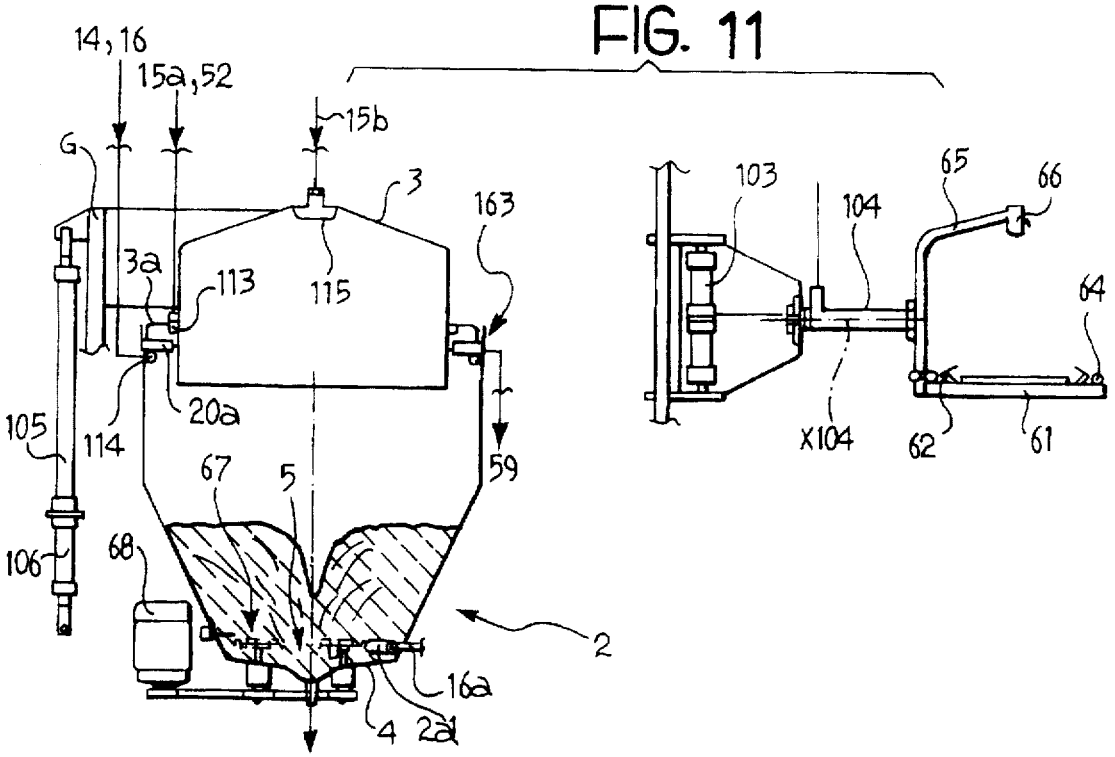
Figure 12:
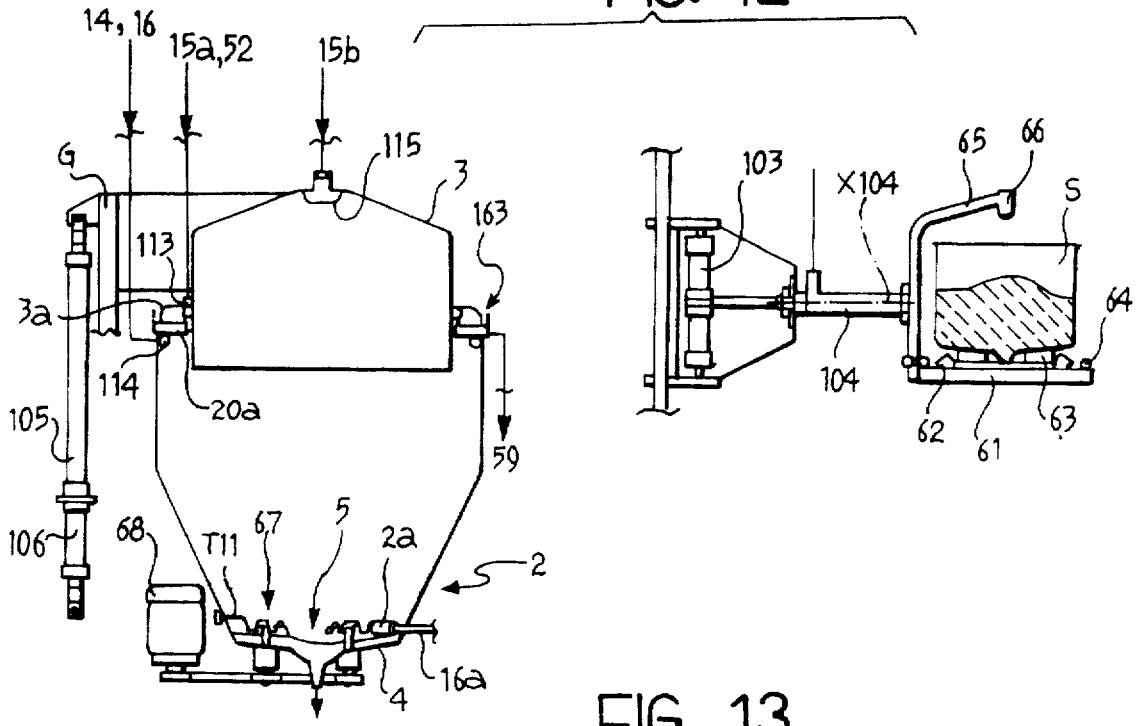
Figure 13:
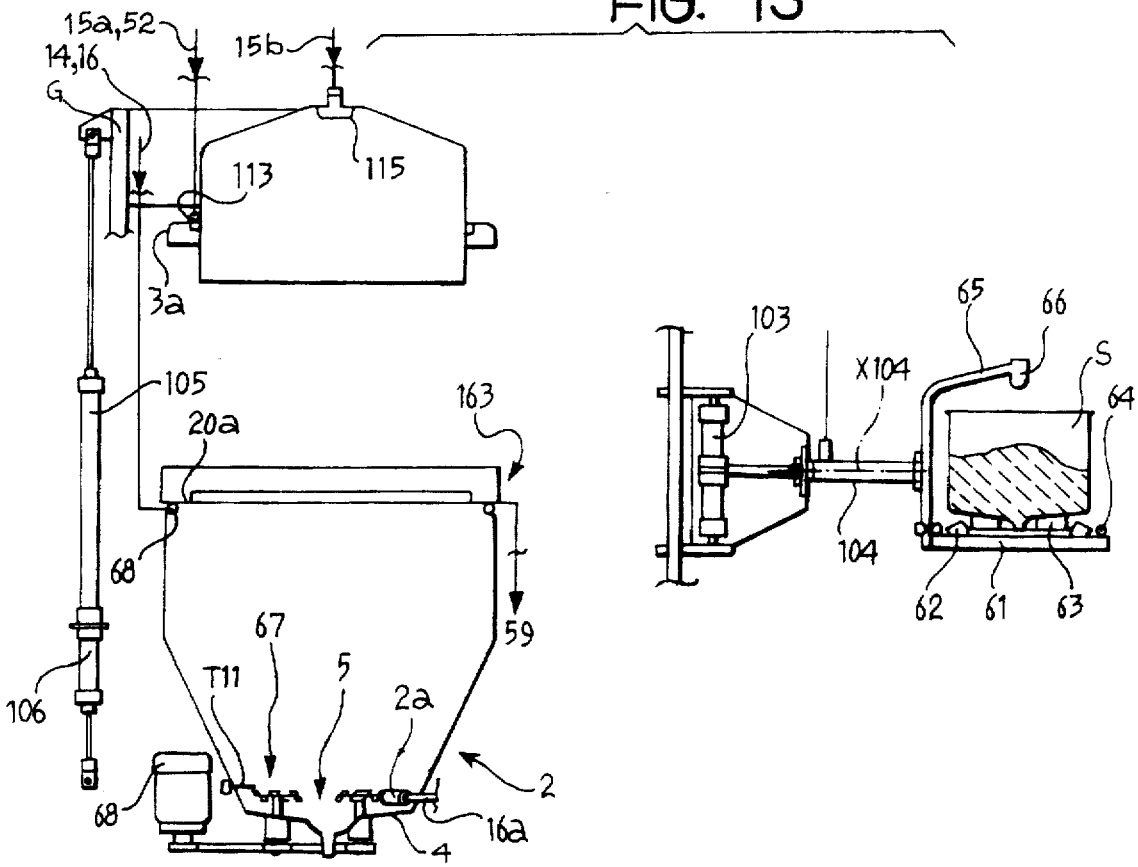

As stated, the lid is mounted on vertical guide elements G (not shown in detail, but of known type) so that it can slide vertically under the action of the jack 105 and 106 between:

an open position, shown in FIGS. 2 to 5, 9 and 13, in which the lid 3 is raised and thus leaves the mouth at the top of the tank 2 clear; in particular, in the position shown in FIG. 2, the distance by which the lid 3 is raised from the tank 2 is such as to allow a bucket S to be inserted in or removed from the tank 2, as will be described further below, a partial closure position, shown in FIGS. 6 to 8, in which the mouth portion of the lid 3 is brought adjacent the mouth portion of the tank 2, and a fully closed position, shown in FIGS. 10 to 12, in which the lid 3 descends further into the tank 2 and hydraulically seals the top of the tank 2 (like a siphon) owing to the presence, around the periphery of the rim of the tank 2 and of the lid 3, of a flange **3*a* and of an annular drip channel 20*a* which is filled with water (as will be described below) and into which the flange 3*a* is dipped when the lid 3** is closed.

To examine the lid 3 again in greater detail, it can be noted that it has a generally cup-shaped structure approximately complementary to that of the tank 2 with a mouth rim which is at the bottom in use, and the diametral dimensions of which are at least slightly smaller than the diametral dimensions of the mouth portion of the tank 2. More precisely, with reference to a preferred but not essential solution in which both the tank 2 and the lid 3 have circular profiles, it can be noted that the dimensions of the lower mouth portion of the lid 3 are slightly smaller than the internal diametral dimensions of the drip channel **20*a*. This enables the lower rim of the lid 3 to penetrate into the tank 2 a certain distance below the drip channel 20*a*, whereas the flange 3*a* (which has a generally L-shaped profile with a root portion projecting from the peripheral wall of the lid 3 perpendicular thereto and a downwardly-facing end portion) can penetrate the water which is in the channel 20*a* so as to ensure the sealed closure of the unit comprising the tank 2 and the lid 3**.

Mounted inside the downwardly-open annular channel defined by the flange **3*a* is a diffuser 113 constituted essentially by an annular duct to which both the output of the valve 15*a* and, by means of a control valve 52, a compressed-air supply line L, are usually connected by means of a flexible pipe which can follow the upward and downward movements of the lid 3. The valve 52 is a solenoid valve independent of the valve 15*a*. It serves, by means of the compressed air, to empty the water out of the interior of the diffuser 113** which would otherwise continue to drip when the cover is raised.

The tubular duct constituting the diffuser 113 has holes (not directly visible in the drawings, for reasons of scale) which are distributed more or less uniformly around its periphery and can act as nozzles for the diffusion of washing fluids (water/air). As will be described further below, when the lid 3 is in the partially closed condition (FIGS. 6 to 8), the supply of water to the diffuser 113 causes the formation of a film which effectively isolates the unit formed by the tank 2 and the lid 3 from the exterior during the inversion of the buckets. It will thus be understood that the diffuser 113 can be used to fill the drip channel **20*a* with water which provides the siphon-like seal when the lid 3** is in the fully closed position.

According to a generally similar arrangement, (except that, in this case, there is no need to provide for a flexible pipe), the output of the valve 14 (and also the output of the non-return valve VR1 which has the function of preventing the passage of the steam into the branch **16*b* during the heating of the device) is connected to a further annular diffuser 114 disposed adjacent the periphery of the mouth portion of the tank 2, immediately below the drip channel 20*a*. In this case, the diffuser in question is also constituted by an annular duct having holes (not readily visible in the drawings) spaced more or less uniformly around its periphery to act as nozzles for projecting the fluid (water or steam) sent through the valve 14**.

It is clear from the foregoing that the valve 14 can be used both for introducing the vector of the solution (water) into the tank 2 and for washing the tank 2. If the valve 14 is opened, the water washes the wall of the tank 2 by means of the diffuser 114, also washing the delivery or injection outlets **2*a***.

A diffuser jet, indicated 115, is situated in the top portion of the lid 3 (which, in the embodiment illustrated, is generally bell-shaped) and is connected to the valve 15*b*. Water can be admitted to the interior of the lid 3 under pressure through the jet 115, typically in order to wash it. The jet 115 also serves for the bucket-inverting stage, when the lid is not sealed like a siphon in the drip channel 20*a*, the tank 2/lid 3 unit then being isolated by the film of water generated by the diffuser 113.

Moreover, a valve, indicated 59, interposed in a discharge duct, enables the liquid in the drip channel 20*a* to be discharged to the exterior (schematically indicated W). A further solenoid valve, indicated 60, connects the output of the electric pump 13 to the cavity inside the arm 104 which is intended to support the buckets S inside the unit formed by the tank 2 and the lid 3.

As a general comment, it should also be noted that the hydraulic/fluid system is described above essentially by way of non-limiting example. It will be appreciated in particular that, in its essential elements, this arrangement closely follows the analogous arrangement of the device of application TO94A000387. Moreover, it should be noted that—according to widely known criteria which do not need to be described herein (and, moreover, are not relevant for the purposes of an understanding of the embodiment of the invention) the various elements included in the fluid/hydraulic system described above (pumps, solenoid valves, meters) as well as the other cooperating elements which will be described below (stirrers operating inside the tank, thermometers, pressure switches, etc.) are all connected to the general control system of the device which is controlled by a processing unit such as a personal computer or a so-called PLC (programmable logic controller).

With reference once more to the mechanical parts of the device, it can be seen that a shelf or plate 61 for supporting the buckets S is mounted substantially like a trowel or pan on the free end of the arm 104 which extends from the body of the turret 100.

As already stated, the arm 104, and hence the plate 61 mounted on its free end, is mounted on the turret 100 in a generally bracket-like or cantilevered arrangement, the activation of the jack 103 (or of an equivalent drive element) enabling the arm 104 to rotate about the horizontal axis X104, imparting thereto a turning movement through 180° (or fractions of this angle) in one sense or in both senses of rotation.

The plate 61 has upper gripping elements 62 which can grip the lower portions of the buckets S in a generally pincer-like configuration. The gripping elements 62, which, for example, (but not necessarily) are provided in positions spaced equiangularly around the periphery of the plate 61, are configured so as to be able to grip a generally cylindrical base portion 63 of the bucket 2 which projects downwardly and can be clasped between the gripping elements 62. These elements are not usually provided with a specific drive. When the plate 61 descends to the rest position, the elements 62 are moved by respective guides (not shown) and are arranged in an open position, releasing any bucket disposed on the plate 61.

It will also be noted that, on the side facing the turret 100, the rim of the tank 2 has a notch 163 which enables the arm 104 to penetrate a certain distance into the mouth portion of the tank 2 when the turret 100 is lowered in order to carry out the dissolving operation.

A further annular diffuser 64 (substantially similar to the diffusers 113 and 114 described above) extends around the periphery of the plate 61. This is also an annular duct which has holes (not specifically visible in the drawings) around its periphery, particularly along its internal surface and spaced more or less uniformly around the periphery of the plate 61. The function of these holes is to act as nozzles in order to project towards the external wall of the bucket S the water which flows into the duct 64 through the cavity of the arm 104 when the valve 60 is opened.

A tubular appendage, indicated 65, extends from the top of the arm 104 and also constitutes a pipe extending along a generally bracket-like structure above the plate 61. The appendage 65 has a shower-head-shaped end 66 which projects in a central position above the bucket S so as to be able to diffuse the water supplied under pressure to the interior of the arm 104 through the valve 60 into the bucket S.

Finally, a paddle- or screw-mixer unit, indicated 67, is situated in the lower portion of the tank 2. There are usually two rotary mixers driven by a common motor, for example, an electric or a hydraulic motor, indicated 68.

Moreover, a thermometer (or similar device), indicated T11, enables the temperature of the vector and/or of the solution present in the tank 2 to be monitored, for example, in order to bring the solution automatically to the desired temperature, for example, by the blowing-in of steam.

As already stated several times, the operating cycle of the device 1 is controlled by a control circuit (electronic, electro-mechanical or electro-fluidic—not shown specifically in the drawings but in any case of known type, for example, of the type controlled by a personal computer or by a so-called PLC) which interacts, by means of respective actuators and sensors (also of known type which do not need to be described in detail below) with the various electric pumps, with the jacks, with all of the valves and/or taps described above, with the motor 68 of the mixer 67, and with the various actuators which bring about the movement of the turret 100. All of this—it is confirmed—takes place according to criteria which are known and/or are within the capabilities of an expert in the design or programming of such control systems.

The operating cycle will be described below, upon the assumption that it starts from the condition shown in FIG. 2, in which the device 1 is arranged for loading. The device is therefore waiting, with its lid 3 kept in the raised position, for the arrival of a bucket S which is loaded (by known means, not shown) onto the plate 61 of the arm 104 of the turret 100 as shown schematically in FIG. 3. It is assumed that a predetermined quantity of product P (for example, dye in powder form) to be dissolved in a vector such as water, or in another fluid, supplied to the tank has previously been metered into the bucket S (in a known manner).

Figure 4:
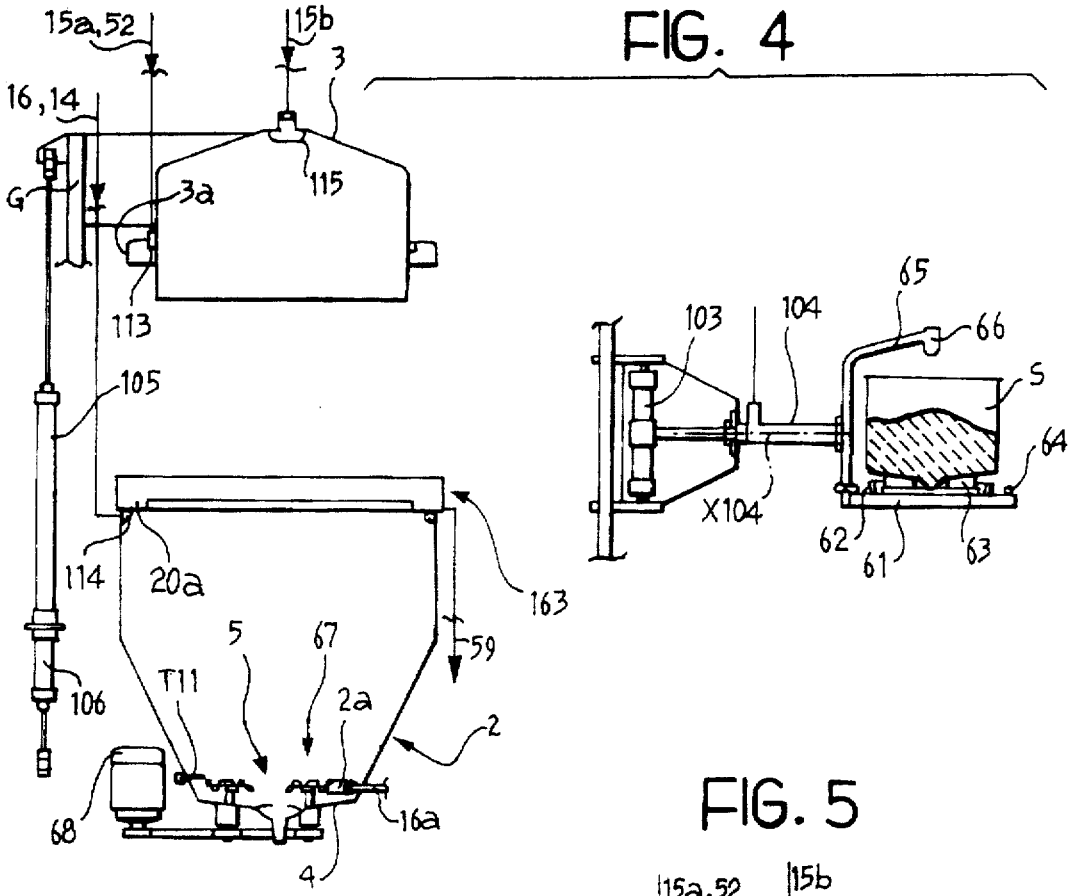
Figure 5:
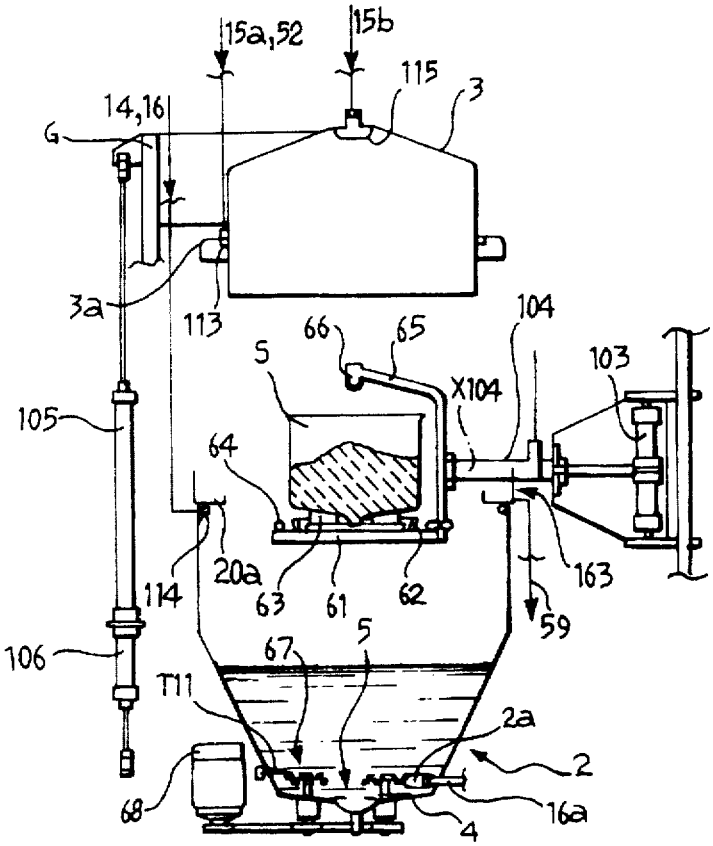

The turret 100 is then raised slightly as a result of the operation of the actuator 102 which, owing to the action of the guides (not shown) which control the gripping elements 62, leads to the clamping of the bucket S onto the plate 61 (FIG. 4)

At this point, the turret 100 loads the bucket S into the device 1 by rotating about its vertical axis X100 from the position shown schematically in FIG. 4. This rotation takes place under the action of the actuator 101 and continues until the plate 61 on which the bucket S is disposed (held in the desired position by the restraining elements 62) is brought to the position shown in FIG. 5. In this position, the plate 61 and the bucket S are aligned with the central axis of the unit formed by the tank 2 and the lid 3 and are hence exposed in the tank 2.

When this position of alignment has been reached, the jack 102 is operated so that the arm 104 with the plate 61 and the bucket S disposed thereon descends a certain distance into the tank 2. For this purpose, the arm 104 slides vertically into the notch 163 until it reaches the position shown in continuous outline in FIG. 5. At this point, as a result of the contraction of the jack 105, the lid 3 is lowered vertically until it is brought to the partial closure position shown in FIGS. 6 to 8. In these conditions, the lower rim of the mouth of the lid 3 is approximately aligned with (at a short radial distance from) the inner rim of the drip channel 20*a*; the channel defined by the flange 3*a* opens downwardly in a position facing and complementary to the drip channel 20*a*, of which the radially outer wall is higher than the radially inner wall (FIG. 6).

At this point or, possibly, during the stage prior to the introduction and lowering of the bucket S in the device 1, the vector fluid of the solution may be loaded into the tank 2. This can be achieved, for example, if dissolving is to take place in hot water, by the opening of the valves 11 and 14 and the supplying of the diffuser 114.

At this point, the contents of the bucket S can be poured out. For this purpose, the processor which supervises the operation of the device 1 operates the jack 103 so as to impart to the arm 104 (and hence to the plate 61 and to the bucket S mounted thereon) an inverting or turning movement. The mouth of the bucket S, which originally faced upwards, is thus turned downwards. The product in the bucket S thus falls into the lower portion of the tank 2 where the previously loaded vector fluid of the solution is disposed. The bucket S does not fall to the bottom of the tank, since it is restrained by the restraining elements 62. The turning movement of the bucket S (shown upon its completion in FIG. 7) does not usually take place in a single step (rotation through 180°) but in successive steps or jumps brought about by the controller by action on the jack 103. Stepped turning enables the contents of the bucket S (typically powder) to fall gradually, preventing the formation of lumps. At the same time, as shown in FIG. 8, the diffuser 113 and the jet 115 are also activated (by the opening of the respective water-supply valves 15*a* and 15*b*. A film of falling water (a liquid film) is thus formed in the space jointly defined by the flange 3*a* and by the drip channel 20*a* as well as in the lower mouth portion of the lid 3 and prevents the product poured in in powder form from spreading outside the unit formed by the tank 2 and the lid 3. The powder is generally poured out of the bucket with the mixers 67 in operation to avoid lumps.

At the same time or immediately afterwards, the electric pump 13 is operated and the valves 11 or 12 and 60 are opened so as to cause water to flow under pressure into the arm 104. The pressurized water is thus diffused in close proximity to the bucket S both by the jet 66 which projects the water into the bucket S and by the diffuser 64 which sprays from above (the bucket S has in fact rotated downwardly) the outer wall of the bucket S as shown schematically in FIG. 8. It will be noted that the jet 115 usually serves for washing the inside of the lid for dissolving and delivery purposes. Any portions of the dye which may have remained attached to the bucket S, or are deposited on the plate 61 and on the elements associated therewith, consequently fall into the lower portion of the tank.

Figure 8:
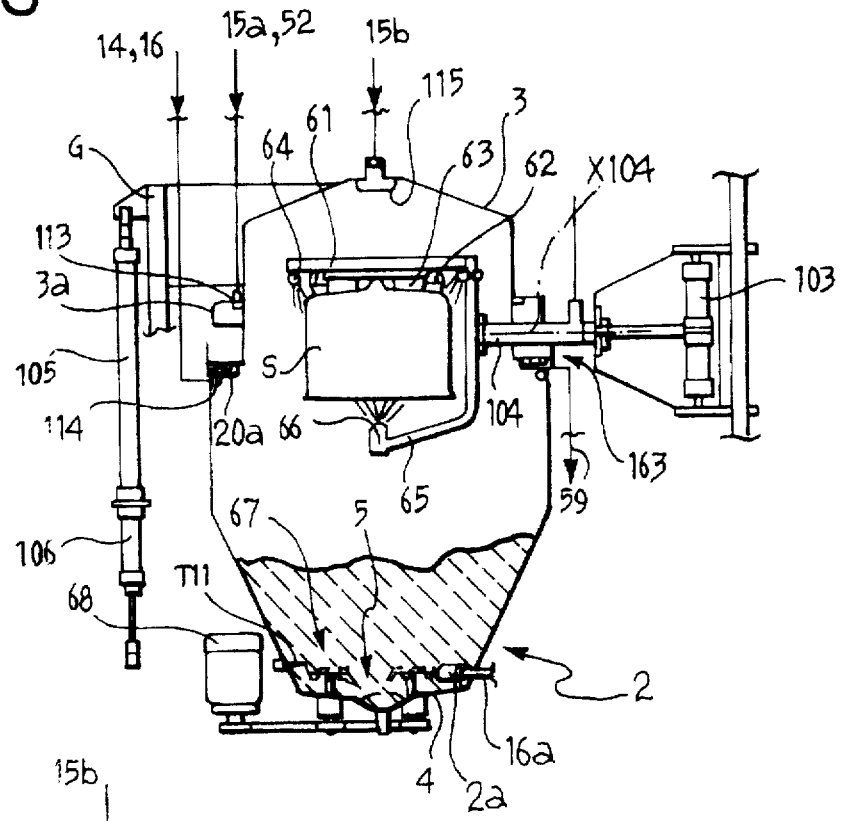

As shown in FIG. 8 the washing of the bucket S usually takes place or is completed after the supplies to the diffuser 113 and to the jet 115 have been cut off.

Figure 9:
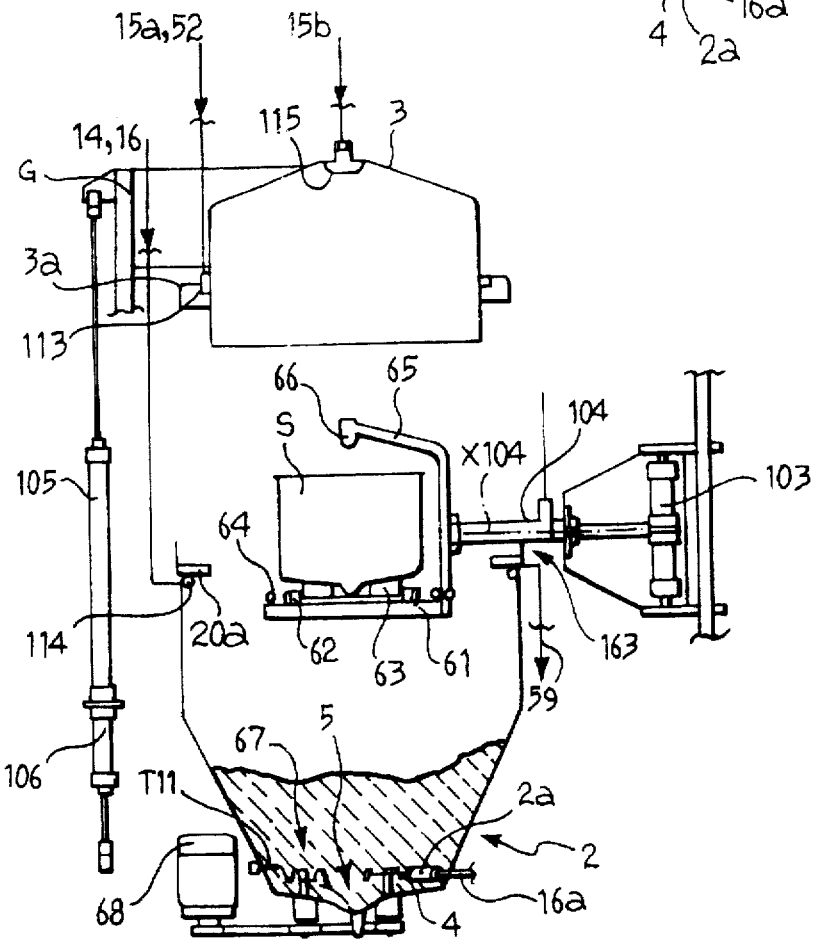
Figure 10:
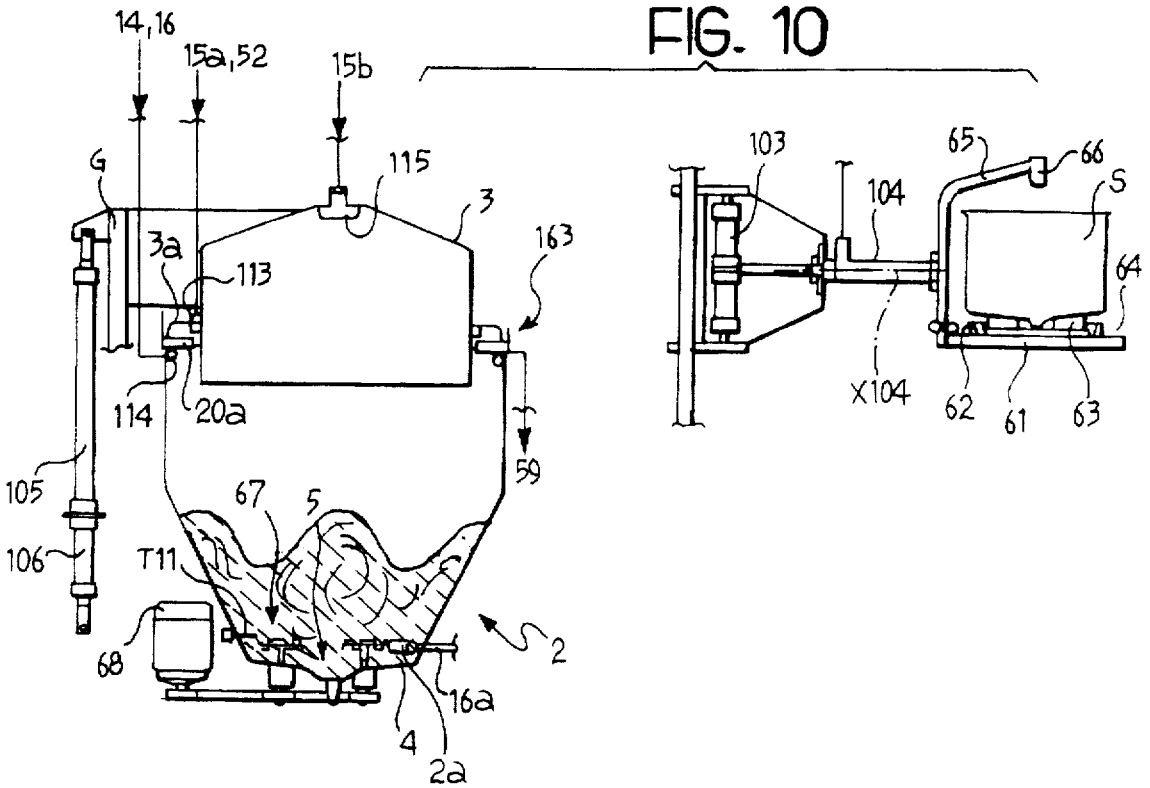

At this point, the bucket S which has previously been turned over and washed, is removed from the unit formed by the tank 2 and the lid 3 by the sequence of operations shown in FIGS. 9 and 10.

Figure 6:
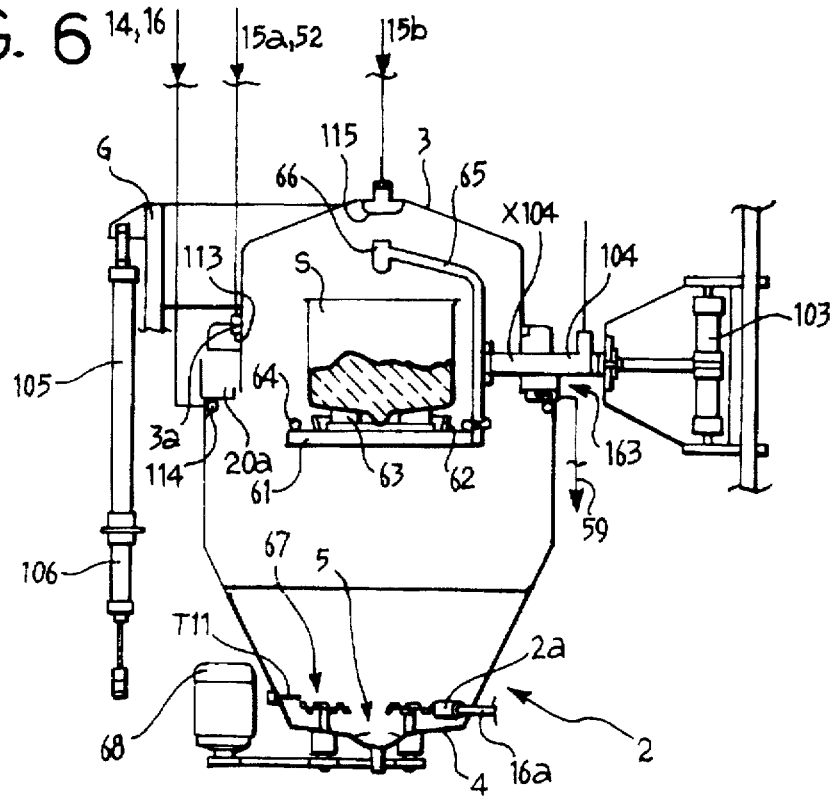
Figure 7:
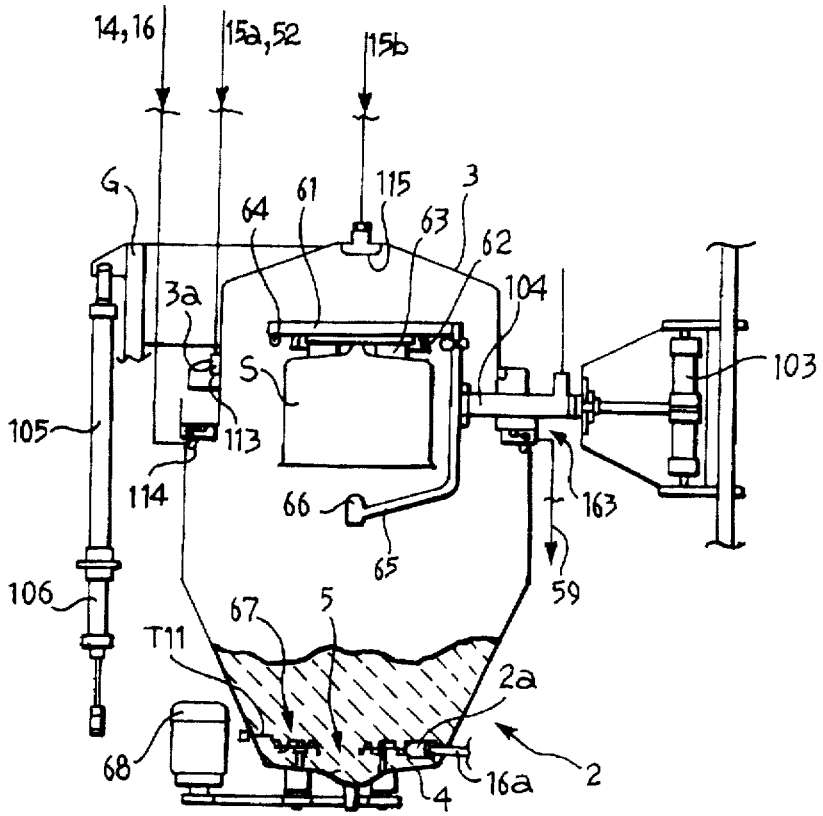

In practice, starting from the partially closed position of FIGS. 6 to 8, the lid 3 is returned to the raised position of FIGS. 2 to 5 which allows the bucket to be removed as a result of the raising of the turret (jack 102) and its rotation about the axis X100.

In particular, the jack 102 is activated in order to raise the turret 100 far enough to bring the arm 104 and the plate 61 with the bucket S disposed thereon to a position in which there is no interference with the rim of the mouth of the tank 2.

The subsequent lowering of the turret (jack 102) with the consequent re-opening of the restraining elements 62 allows the bucket S containing a further dose of product to be dissolved to be picked up by the plate 61.

The sequence of FIGS. 3 to 9 can thus be repeated for any number of buckets from 1 to n before the mixing stage is carried out.

When the last bucket of the sequence (which may even be a single bucket) has been removed, the lid is lowered to the fully closed position (siphon-like sealing of the flange 3*a* in the drip channel 20*a*) and the mixing and any heating are started.

The mixing stage is carried out by the activation of the motor 68 which drives the paddle- or screw-mixers 67 associated therewith. The activation of the mixer 67 brings about mixing of the mass constituted by the vector fluid and by the product poured into the tank 2 from the bucket or buckets S. This stirring mechanism, which is activated for a predetermined period of time (from a few tens of seconds to 3–4 minutes) can ensure that the product poured from the bucket S (for example a dye) is dissolved completely and homogeneously in the vector liquid until a solution (or, in general, a mixture) is formed.

The mixing (shown schematically in FIG. 10) brought about by the activation of the motor 68, is usually preceded by heating of the contents of the tank 2 as a result of the feeding of steam into the lower portion of the tank 2 through the outlet or outlets 2*a* as a result of the opening of the valve 16. The temperature reached by the solution can be monitored by means of the temperature sensor T11 disposed in the lower portion of the tank 2.

Upon completion of the mixing, and when the operation of the mixer 67 driven by the motor 68 has stopped, the controller switches the valve 18 to the position which puts the opening 5 of the tank 2 into communication with the suction side of the pump 7 and hence with the pipe 6, one of the valves VDU1, VDU2, VDU3, etc. also being switched to the position for diversion to the respective tank V1, V2, V3 . . . for which the solution is intended.

This operating condition (FIG. 11) is maintained until the desired amount of the previously-prepared solution has been discharged.

At this point, the device 1 is prepared for a tank-washing cycle. This may, however, already have been started (continuously or with timing), as schematically shown in FIG. 12, during the emptying of the tank 2 as a result of the operation of the electric pump 13 and movement of the valves 14 and 15*b* to the open position so as to cause washing water to flow towards the diffusers 114 and the jet 115 and to pass over the internal surface of the tank 2 including the lid 3.

The washing operation can be organized in cycles performed with quantities of water which can be set selectively. The destination of the washing water can also be set selectively to the discharge W or to one of the tanks V1, V2, V3 . . . , if the dissolved material (dye) is to be recovered.

The washing residues are discharged through the pipe 6 as a result of the operation of the electric pump 7 with the valve 18 in the working position which puts the opening 5 into communication with the pipe 6 and the valve VDU1, VDU2, VDU3, . . . in the open condition so as to put the pipe 6 into communication with the respective tank V1, V2, V3 . . . or the discharge W.

Upon completion of the washing, the valve 18 returns to the working position and, by the opening of the valves 11 or 12 and 17, a final safety washing is carried out towards one of the tanks V1, V2, V3 . . . or W, with a set quantity of water.

At this point, the controller operates the jack 105 and 106 again so that it lifts the lid 3 to the open position (return to the condition shown in FIG. 2); the tank 2 is thus ready to receive a new bucket S containing a certain quantity of dye P to be dissolved, which is admitted to the tank by the repetition of the cycle described above with reference to FIGS. 3 to 12. As already stated if, according to the preferred embodiment of the invention, the device 1 has two associated turrets 100, the overall efficiency of the cycle for the loading and unloading of the buckets S is increased; as soon as one turret 100 has removed a bucket S just used and washed from the tank 2, the other turret is in fact ready to bring into the tank 2 a new bucket S into which a certain quantity of dye to be dissolved has previously been metered, in order to prepare a new mixture.

Naturally, the principle of the invention remaining the same, the details of construction and forms of embodiment may be varied widely with respect to those described and illustrated, without thereby departing from the scope of the present invention. This applies in particular with regard to its possible use in a field other than the textile industry referred to by way of example.

What is claimed is:

1. A device for preparing mixtures of a product and a vector solvent, the device comprising:

a tank in which a mixture is formed, means for supplying a vector to said tank, support means for supporting a container, the support means including means for permitting selective inversion of the container supported by the support means so as to pour a product disposed in the container into the tank, stirring means for mixing in the tank the product poured from the container into the vector, and supply means for taking the mixture from the tank in order to distribute it to at least one user position, wherein said support means comprises an arm having an end adapted to support the container, and drive means for imparting to the arm:

a swinging movement between at least one position in which the end of the arm is outside the tank and at least one position in which the end of the arm is exposed to the inside of the tank, and a rotary movement about a generally horizontal axis in order to invert the container supported by the arm so as to pour the product disposed in the container into the tank.

2. A device according to claim 1, wherein said drive means also imparts to the arm, at least when it is in the second position, a vertical translational movement relative to the tank.

3. A device according to claim 2, wherein said drive means also imparts vertical translational movement to the arm when the arm is in the first position, and wherein the clamping means includes means for operating the clamping means as a result of the vertical translational movement when the arm is in the first position.

4. A device according to claim 2, wherein the tank includes a mouth portion having a notch which allows the arm to descend a certain distance into the tank as a result of the vertical translational movement.

5. A device according to claim 1, wherein said end of the arm is formed substantially as a plate.

6. A device according to claim 1, wherein the end of the arm includes clamping means for restraining the container on the end of the arm.

7. A device according to claim 6, wherein a projecting element is secured to a lower portion of the container and is adapted to face towards the end of the arm, and wherein said clamping means clamps onto the projecting element.

8. A device according to claim 1, further including duct means supported by the arm for feeding a fluid to the end of the arm so that the fluid strikes at least one of the internal and external surfaces of the container, said duct means adapted to be in fluid communication with means for providing the fluid.

9. A device according to claim 8, wherein an appendage supported by the arm extends above the container supported by the arm and carries a spray element in fluid communication with said duct means for spraying the fluid into the container.

10. A device according to claim 9, further including a generally annular distributor element in fluid communication with said duct means and extending around the periphery of the container in order to spray the fluid onto the external surface of the container.

11. A device according to claim 10, wherein the end of the arm is formed substantially as a plate, and the distributor element extends around the periphery of the plate.

12. A device according to claim 1, further including covering means for the tank and means for selectively moving said covering means between an open position in which the arm can move away from and towards the second position, and at least one closure position in which the covering means closes the tank.

13. A device according to claim 12, wherein said covering means is in the form of a lid which moves upward and downward relative to a mouth portion of the tank.

14. A device according to claim 12, wherein both the tank and the covering means are generally cup-shaped.

15. A device according to claim 12, further including means for forming a liquid-film seal between the tank and the covering means.

16. A device according to claim 15, wherein said means for forming the liquid-film seal forms a siphon-type seal.

17. A device according to claim 16, wherein the covering means is movable to:

a first position for the closure of the tank, in which the unit formed by the tank and the covering means is isolated by means of the water-film seal, and a second position for the closure of the tank, in which the unit formed by the tank and the covering means is isolated by means of the siphon-type seal.

18. A device according to claim 17, wherein the first and second closure positions correspond to a farther and closer position, respectively, of the covering means relative to the tank.

19. A device according to claim 16, wherein the means for forming the siphon-type seal comprises:

a drip channel supported along a rim of the tank and adapted to be filled with a liquid, and a flange which projects from the covering means and is adapted to be dipped sealingly in the liquid in the drip channel when the covering means is in the closure position.

20. A device according to claim 19, wherein the flange defines a respective channel opening towards the drip channel, and liquid-supply means is provided for selectively supplying liquid towards the respective channel so as to form the liquid film.

21. A device according to claim 12, further including at least one spray element and fluid-supply means fluidly coupled to said spray element, said spray element being in a position generally at a top portion of the covering means to selectively supply fluid to an interior of the covering means.

22. A device according to claim 1, wherein said tank has a mouth portion provided with a diffuser element fluidly coupled with a fluid-supply means for selectively supplying fluid to the interior of the tank.

23. A device according to claim 1, further including means for heating a fluid supply, and means for selectively supplying a heating fluid from said fluid supply to the interior of the tank.

24. A device according to claim 1, further comprising thermometric sensor means for monitoring the temperature of at lest one of the vector and the mixture in the tank.

25. A device according to claim 1, wherein said support means further includes a turret structure from which the arm projects.

26. A device according to claim 25, wherein said drive means includes:

first drive means for rotating the turret about a vertical axis in order to impart the said swinging movement to the arm, and second drive means for imparting the said rotary movement of the arm.

27. A device according to claim 26, wherein said drive means further includes third drive means secured to the turret for imparting a vertical translational movement to the arm.

28. A device according to claim 1, wherein said support means includes a plurality of arms including a first arm and a second arm, each arm having an end adapted to support a container and a said drive means which operates such that, when one of the arms moves from the second position to the first position to remove a container from the tank, the other arm moves from the second position to the first position to bring a container into the tank.

29. A device according to claim 1 or claim 2, wherein the drive means includes a plurality of fluid jacks.

* * * * *